United States Patent [19]

Alessio et al.

[11] Patent Number: 5,044,383

[45] Date of Patent: Sep. 3, 1991

[54] DISPOSABLE MANICURE DEVICE

[76] Inventors: Gerald Alessio, 127 Nottingham Ct., Montvale, N.J. 07645; William G. Blasius, Jr., West Shore Dr., Higganum, Conn. 06441; Joseph Silberberg, 1084 E. 28th St., Brooklyn, N.Y. 11210

[21] Appl. No.: 462,845

[22] Filed: Jan. 2, 1990

Related U.S. Application Data

[63] Continuation of Ser. No. 863,657, May 15, 1986, abandoned.

[51] Int. Cl.[5] ..... A45D 29/00

[52] U.S. Cl. ..... 132/73; 132/320; 604/1

[58] Field of Search ..... 132/73, 320, 318, 317, 132/73.5, 75.6, 75.5, 75.4, 75.3, 76.5, 76.4; 604/1, 3, 289, 291, 294

[56] References Cited

U.S. PATENT DOCUMENTS

| | | | |
|---|---|---|---|
| 1,367,974 | 2/1921 | Ivory | 132/73 |
| 1,413,033 | 4/1922 | Keyser . | |
| 1,819,004 | 8/1931 | Roessinger | 132/73 |
| 1,848,751 | 3/1932 | Schnefel | 132/73 |
| 2,006,539 | 7/1935 | Deford | 604/1 |
| 2,192,733 | 3/1940 | Bader, Jr. | 132/90 |
| 2,364,085 | 12/1944 | Martinek | 132/73.5 |
| 2,480,446 | 8/1949 | Carlson | 132/73 |
| 2,513,208 | 6/1950 | Rogers | 132/73 |
| 2,538,076 | 1/1951 | Bates | 15/210 |
| 2,705,009 | 3/1955 | Plantinga et al. | 604/1 |
| 3,324,849 | 6/1967 | Kravitz | 604/1 X |
| 3,443,562 | 5/1969 | Gustafson | 604/1 |
| 3,586,380 | 6/1971 | Alibeckoff | 604/1 |
| 3,871,375 | 3/1975 | Bennet | 604/1 |
| 3,888,810 | 6/1975 | Shinomura | 260/17.4 BB |
| 3,910,293 | 10/1975 | Lemelson | 132/89 |
| 3,958,571 | 5/1976 | Bennington | 604/3 |
| 4,228,116 | 10/1980 | Colombo et al. | 264/119 |
| 4,401,130 | 8/1983 | Halford et al. | 604/1 X |
| 4,491,553 | 1/1985 | Yamada et al. | 264/51 |
| 4,718,889 | 1/1988 | Blasius, Jr. et al. | 604/1 |
| 4,767,398 | 8/1988 | Blasius, Jr. | 604/1 |
| 4,795,421 | 1/1989 | Blasius, Jr. et al. | 604/1 |

FOREIGN PATENT DOCUMENTS

| | | | |
|---|---|---|---|
| 2302454 | 7/1973 | Fed. Rep. of Germany | 132/88.5 |
| 2129143 | 10/1972 | France | 132/88.5 |

*Primary Examiner*—Kenneth J. Dorner
*Assistant Examiner*—J. Hakomaki
*Attorney, Agent, or Firm*—Melvin E. Kurtz; Daniel S. Ortiz

[57] ABSTRACT

A manicure device is described which comprises an applicator stick which, at one end, has an absorbent swab tip over one end of the stick and which at its opposed end merges with an integral manicure tip. The stick is preferably formed of a composite of polymer, e.g. polypropylene, and wood chip filler, e.g., a softwood chip filler.

5 Claims, 1 Drawing Sheet

DISPOSABLE MANICURE DEVICE

This is a continuation of application Ser. No. 863,657, filed May 15, 1986, now abandoned.

BACKGROUND OF THE PRESENT INVENTION

1. Field of the Invention

The present invention is a disposable manicure device which can be used in the care of the nails.

2. Description of the Prior Art

U.S. Pat. No. 1,413,033 to E. W. Keyser illustrates a cuticle stick having a be beveled wedge or chisel-like form at one end and a reduced neck portion at the other end having an annular channel or groove designed for the reception of the loose ends of fibers of a cotton wrapping or swab. The swab is intended to be dipped into a liquid cleansing solution adapted to be applied to the cuticle. In discussing his invention, the patentee, Keyser, alluded to the prior use of a wad of absorbent cotton applied to the end of a stick in the form of a loose wrapping so as to be adapted to be dipped into a liquid cleansing solution for the cuticle. In such products he indicated that the wrapping often slipped from the stick and became lost in the bottle into which it was dipped. The Keyser patent does not indicate whether or not such a prior cuticle stick also contained an integral manicure implement at the end of the stick remote from the end carrying the absorbent wad.

More recently, in U.S. Pat. No. 2,588,076 to M. R. Bates a manicuring device is described which contains, at one end, a manicure tip with provision made for placement of a cylindrical absorbent material in a hollow bore within the device for dispensing through an opening at the other end.

Even more recently than either of the two aforementioned patents, it has been common practice for persons in the manicure art to utilize two separate implements to fulfill the need satisfied by the Keyser and Bates devices. The first implement is a swab product comprising an application stick having a cotton swab attached to one end thereof. This product is adapted to be dipped into an appropriate solution for application of a treatment solution to the cuticle. A second, separate implement, formed of natural wood, had an appropriate manicure implement tip which would allow for appropriate manipulation of the cuticle by the user.

SUMMARY OF THE PRESENT INVENTION

The present invention is a manicure device which comprises an applicator stick of substantially cylindrical shape which, at one end, has a substantially cylindrical, non-grooved shape underlying an adherent swab member formed of absorbent fibrous material and which, at its opposed end, merges with an integral manicure tip. The present invention, in a preferred embodiment, is a disposable, low cost implement which combines a manicure implement and an absorbent swab into a single device. It preferably has a stick which is formed of a thermoplastic polymer/wood chip composite. The use of such a composite enables the manufacturer to prepare sticks of more uniform quality than might be possible with the use of natural wood. The use of a polymer/wood chip composite obviates potential problems in regard to splinters resulting from the use of a natural wood stick. The polymer/wood chip composite can also be engineered to have the desired stiffness and level of absorbency for the cleaning solution to give the desired level of utility and comfort. Hardwood sticks, as normally used, are sometimes too hard and do not have the desired absorbency characteristics.

DESCRIPTION OF THE DRAWINGS

The present invention will be more fully understood by reference to the drawings which form a portion of the present specification wherein.

DETAILED DESCRIPTION OF THE PRESENT INVENTION

Figure 1:
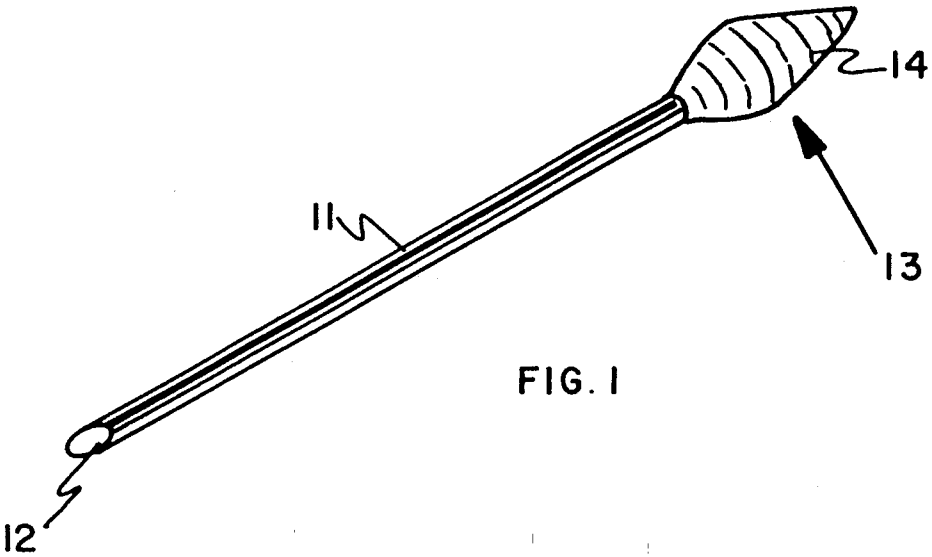
FIG. 1 is a perspective view showing the manicure device of the invention.
Figure 2:
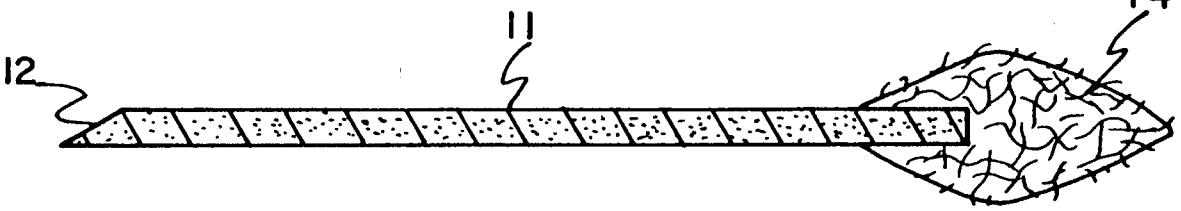
FIG. 2 is a cross-sectional view of the device illustrating the swab tip and manicure implement constructions, respectively, of the device of the present invention.

The present invention can be understood by reference to FIG. 1 in the Drawings wherein an applicator stick 11 of substantially cylindrical cross-section terminates at one end in an appropriate manicure tip 12 which can be used by the manicurist or user to appropriately manipulate the cuticle and which has its other end 13 covered with an appropriate absorbent swab tip 14 for absorbing a cuticle treatment solution. The swab tip 14 can comprise a suitable non-woven fibrous material such as cotton, and it is attached to the applicator stick 11, as best shown in FIG. 2, by conventional means for attaching swabs to applicator sticks in other products. Generally this is done by the use of adhesive. However, if a stick 11 is used which contains a suitable amount of thermoplastic polymer, such a stick can be passed over an apparatus which prejudicially melts the polymers. Fibers can then be directly bonded to the molten plastic. Essentially, the composite plastic serves as its own hot melt adhesive.

The swab tip 14 is conical in shape in a preferred embodiment. This form makes the swab tip especially useful for removing nail polish from the area of the cuticle. A solution of gum arabic (e.g., at 2% solids) can be used during the swab forming process as a binder. This binder, when dry, allows the swab to be used with such solvents as acetone, in treatment of the cuticle, without losing its shape.

The applicator stick 11, in a preferred embodiment, is formed of a thermoplastic polymer, e.g. a polyolefin such as polypropylene, which is appropriately loaded with a cellulosic filler such as wood chips. The polymer alone, although having sufficient solvent resistance, is too flexible and is completely non-absorbent. Wood chips from such softwood species as pine or spruce are preferred because of their better absorbency over hardwood species such as walnut or oak. The more absorbent wood species will have some degree of absorbency towards the treatment solution, although it will be far less than the absorbency of the swab tip 14. In a preferred embodiment, the wood composite can be made by mixing together 60 parts by weight of a homopolymer of propylene (melt index=2.5, in granular form). 40 parts by weight of coarse fibrous softwood flour (150 mesh) and small amounts of appropriate lubricant, stabilizer, and pigment (e.g., white pigment) additives. Hardwood flours or nutshell flours do not provide the desired level of fibrous reinforcement and contribute too much hardness. The mixing can be performed in a high intensity mixer, ribbon blender or a V-type blender. The resulting mixture can be compounded at 375°-425° F. in a twin screw or single screw extruder, preferably with venting to remove moisture. This operation can Yield dry pellets which, if extruded at 35O°–425° F. through a suitable die, can be used to make rod-like applicator sticks.

The following Examples are provided to exemplify certain embodiments of the present invention.

EXAMPLES 1–4

Sticks were extruded on a 0.75 inch laboratory extruder at the conditions described before. The 3.18 mm diameter sticks were tested on a Tinius-Olsten stiffness tester using a 5.08 cm span. This tester bends the stick to various angles and provides the bending moment at each desired angle.

The compositions tested were:

| Example No. | Composition of Stock |
|---|---|
| 1 | Polypropylene |
| 2 | 60% Polypropylene |
| | 40% Hardwood flakes |
| 3 | 60% Polypropylene |
| | 40% Softwood flakes |
| 4 | 60% Polyethylene, high density |
| | 40% Softwood flakes |

The following bending moment (in inch-lbs) and degrees of bending to break the stick were obtained ("NB" indicates that no breaking of the sample occurred):

| Composition of Example No. | Bending Moment at 5° | 10° | 15° | 20° | 25° | Degrees to Break |
|---|---|---|---|---|---|---|
| 1 | .15 | .30 | .40 | .50 | .60 | NB |
| 2 | .60 | 1.00 | 1.30 | 1.40 | 1.50 | 36 |
| 3 | .55 | .90 | 1.10 | 1.15 | 1.20 | 68 |
| 4 | .35 | .45 | .55 | .65 | .65 | NB |

The above data illustrate that softwood filler in polypropylene exhibits the best balance of stiffness (as illustrated by the breaking moment data) without brittleness (break).

The foregoing is intended to illustrate certain embodiments of the present invention but should not be construed in a limiting fashion. The scope of protection that is sought is set forth in the claims which follow.

We claim:

1. A manicure device which comprises: an applicator stick, formed from a wood filled polyolefin, having at one end, a substantially cylindrical portion, an adherent swab member, formed of an absorbent fibrous material, the swab member overlying the substantially cylindrical portion of the applicator stick, the entire portion of the applicator stick underlying the swab member being free of transverse grooves and which applicator stick at its opposed end, merges into with an integral manicure tip.

2. A device as claimed in claim 1 wherein the swab member comprises non-woven cotton fibrous material.

3. A device as claimed in claim 1 wherein the swab member comprises non-woven cotton fibrous material and the applicator stick comprises a thermoplastic polymer filled with softwood chips.

4. A device of claim 3 wherein the thermoplastic polymer is polypropylene.

5. A device of claim 1 wherein the polymer is polypropylene.

* * * * *